United States Patent [19]

Thomas

[11] 4,100,784

[45] Jul. 18, 1978

[54] FINNED TUBING

[75] Inventor: Hector Thomas, Johannesburg, South Africa

[73] Assignee: Heat Exchangers Africa Limited, Johannesburg, South Africa

[21] Appl. No.: 819,658

[22] Filed: Jul. 27, 1977

[30] Foreign Application Priority Data

Aug. 9, 1976 [ZA] South Africa ..... 76/4761

[51] Int. Cl.[2] ..... B21H 3/12

[52] U.S. Cl. ..... 72/98; 29/157.3 AH

[58] Field of Search ..... 72/78, 98; 29/157.3 R, 29/157.3 A, 157.3 AH

[56] References Cited

U.S. PATENT DOCUMENTS 3,648,502 3/1972 Klug et al. ..... 72/98

3,745,801 7/1973 Kallfelz et al. ..... 72/98

*Primary Examiner*—Lowell A. Larson

*Attorney, Agent, or Firm*—Ladas, Parry, Von Gehr, Goldsmith & Deschamps

[57] ABSTRACT

This invention provides for a method of and apparatus for the manufacture of finned tubing, more particularly high-fin tubing, from tubular metal fin stock on a tube liner by means of a plurality of rollers rotatably drivable by means of arbors and each roller including a plurality of axially arranged forming discs. At least some of the discs have recessed cross-sectional profiles including radially extending recessed portions radially spaced from the disc peripheries so that when these discs are forced into the metal fin stock the fin stock is only in partial contact with the discs during the formation of the fin and is not in contact over the recessed portions.

47 Claims, 12 Drawing Figures

FINNED TUBING

BACKGROUND TO THE INVENTION

This invention relates to finned tubing. The invention relates in particular to a method of and apparatus for manufacturing bimetal finned tubing and to finned tubing manufactured in accordance with the method.

More specifically, the invention relates to the manufacture of bimetal finned tubing from tubular metal fin stock on a tubular metal liner by means of a plurality of rollers drivably mounted on arbors spaced about the tubular fin stock. Each of such rollers includes a plurality of axially arranged forming discs and the arrangement is such that the discs on the respective rollers track with each other. The discs can be brought into rolling contact with the fin stock and when this is done and the arbors are driven, the discs penetrate into the fin stock and deform the stock so that the metal in the fin stock is forced into axial spaces between the forming discs to thereby form fins on the tube liner. The axes of the arbors intersect the axis of the tubular fin stock so that when the arbors are driven the forming discs traverse the fin stock longitudinally and thereby extrude helical fins from the fin stock. Due to pressures exerted by the forming discs on the fin stock during the extrusion of the fins, the fins thus formed engage the tube liner frictionally.

According to the invention there is provided a method of manufacturing finned tubing from tubular metal fin stock on a tube liner by means of a plurality of rollers rotatably drivable by means of arbors and each roller including a plurality of axially arranged forming discs, the method including deforming the metal of the fin stock to form a fin by forcing the metal into a restricted radially directed axial space defined between adjacent forming discs so that the metal is uninterruptedly in contact with a portion of the axially directed face of one disc defining the restricted space but is only in partial contact with the opposing axially directed face of the adjacent forming disc defining the restricted space, there being no contact over a radially extending portion spaced radially inwardly from the disc periphery.

At least some of the discs may be resiliently flexible. Thus the method may further include applying lateral pressure in an axial direction to the fin by deflection of a forming disc. During the application of lateral pressure to the fin, the fin may be inclined with respect to the axis of the tube liner..

Further according to the invention there is provided an apparatus for manufacturing finned tubing from tubular metal fin stock on a tube liner, the apparatus including a forming disc which is mountable on a rotatably drivable arbor so as to be rotatable in a direction transverse to the rotational axis of the arbor, the disc having a cross-sectional profile of which a radially extending portion is recessed in the axial direction of the disc with respect to the profile regions which are radially adjacent to the recessed region.

The disc may be resiliently flexible in its axial direction and may be capable of applying lateral pressure in the axial direction of the disc to a fin formed from the fin stock. Thereby the fin may be inclined with respect to the axis of the tube liner.

The recessed portion in the cross-sectional profile of a forming disc in accordance with the invention may be provided in one axial side only of the disc, while the other axial side of the disc may have a regular, generally linear or curved profile. Alternatively, recessed portions in the profile may be provided in both axial faces of the forming disc.

The recessed portion may be formed by a smoothly curved region on the forming disc intersecting a linear portion. The curved portion may be provided inwardly of the periphery of the disc and may be so shaped that the profile initially diverges from the periphery of the disc in a radially inward direction and then converges, whereafter the profile again diverges radially inwardly. The arrangement is such that a tangent extending between the prominence on the curved portion of the profile formed between the divergent and convergent regions bridges the recessed region before it contacts a radially inward portion of the disc profile. This arrangement ensures that metal forced into a gap defined on one side by the recessed portion will not contact the forming disc along the recessed portion.

At least some of the discs may be dish-shaped when not in use and may be mounted so that their dished faces are directed against the direction in which lateral pressure is applied to the fin, the lateral pressure tending to deform the discs, and the dished shapes of the fins tending to resist such lateral pressure and deformation under the lateral pressure.

Furthermore, at least some of the discs may have asymmetrical cross-sectional profiles.

Still further, the recessed portion of the disc may be provided in the dished surface.

The cross-sectional profile of the disc in the face in which the recessed portion is provided may include an annular shoulder at the radially inward extremity of the profile.

The periphery of the disc may be a sharp edge or it may be blunt and may be in the form of a peripherally extending flat surface.

In a particular embodiment the thickness of the disc may be 1.6 mm.

The discs may be provided in at least two groups, the discs in one group effecting penetration of the fin stock and initial forming of the fin and another group effecting final forming and finishing of the fin. The second group of discs may effect radially extending the fin and forcing the fin back onto the tube liner.

The discs may be provided in two groups by positioning a stiff, relatively inflexible restraining disc between the two groups, the restraining disc resisting deformation of the two groups of discs under lateral pressure applied to the discs in opposite directions.

The diameters of the forming discs in the first and the second groups may gradually increase. The angle of a line extending axially over the peripheries of the diametrically increasing discs with respect to the axis of the tube liner may be 6° in the first group and about 1° in the second group.

The angle of inclination of the arbor axis with respect to the tube liner axis determines the pitch of the helical fin. The lead angle may be example be 30 minutes (half of a degree), and this may result in a helical fin having a pitch of eleven fins per 25 mm (one inch) i.e. a pitch of 2.3 mm. The arbor may be rotated at 730 rpm. At this rotational speed a fair amount of heat is generated due to friction, and in order to alleviate this a lubricant/coolant may be used. A suitable lubricant/coolant may be a substance including a fatty acid.

The invention further extends to a roller for manufacturing finned tubing from tubular metal fin stock on a tube liner, the roller including a plurality of discs mounted in an axial arrangement on an arbor in which at least some of the discs are in accordance with the apparatus of the invention.

In one arrangement, the discs may be mounted so that they abut each other axially.

Alternatively, spacers may be provided between the discs so that the discs are thereby axially separated from each other.

The discs may be provided in at least two groups, the discs in one group effecting penetration of the fin stock and initial forming of the fin and another group effecting final forming and finishing of the fin.

A stiff, relatively inflexible restraining disc may be positioned between the two groups, the restraining disc resisting deformation of the two groups of disc under lateral pressure applied to the discs.

Both groups may include dished discs and may be so mounted that their dished faces are directed towards the restraining disc.

At least four of the discs immediately adjacent either axial side of the restraining disc have blunt peripheries in the form of flat peripheral surfaces.

Conveniently, the roller may include from 31 to 33 discs.

A roller in accordance with the invention may include a plurality of forming discs in several groups, the cross-sectional profiles of the forming discs in the several groups being different, but the cross-sectional profiles of the discs in any one group being substantially the same.

There may conveniently be provided four groups of forming discs in the roller. The first group may have sharp wedge-shaped peripheries to facilitate penetration of the tubular fin stock. The discs in the next group may have cross-sectional profiles similar to those in the first group, but the profiles may be less sharp and may be slightly curved and may also be of gradually increasing thickness in order to gradually compress the metal between the discs. The discs in the third group may have cross-sectional profiles with recessed portions in accordance with the invention for forming the fin stock and gradually raising the fin. The peripheries of these discs may be slightly curved. The fourth group of discs may have cross-sectional profiles similar to those of the third group but their peripheries may be sharper. The discs in this group perform a finishing action on the extruded fin. Finally, a buttress disc is provided which is resiliently flexible and applies lateral pressure in an axial direction to the fin.

The invention still further extends to finned tubing whenever made in accordance with the method of the invention.

The tube liner and the fin stock may be different metals. The tube liner may for example be steel, more particularly carbon steel, while the fin stock may be aluminium.

The invention is now described with reference to the accompanying drawings, in which.

Figure 1:
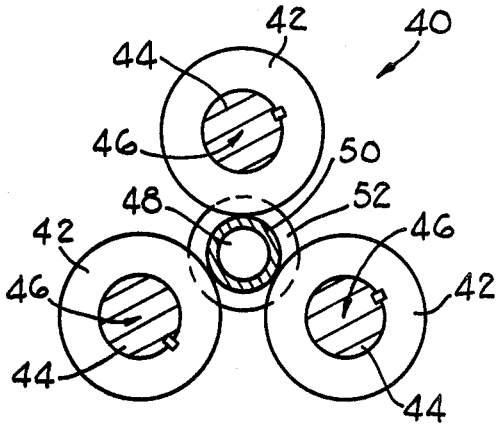
FIG. 1 shows an end view of three fin forming rollers with a tubular fin stock and a tube liner positioned between them in a fin rolling position.

Referring to FIG. 1, reference numeral 40 indicates the fin rolling apparatus in general. It includes three rollers 42 which are fixedly mounted on arbors 44 having each a rotational axis 46. The arbors 44 are equidistantly spaced about the axis 48 of a tube liner 50 inside a tubular fin stock 52. When the arbors 44 are driven they rotate the rollers 42 and due to rolling contact between the rollers 42 and the fin stock 52, the fin stock is contra-rotated about the axis 48.

Figure 2:
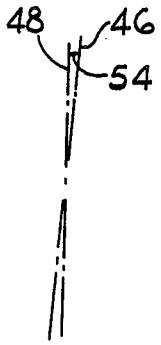
FIG. 2 shows a plan view of the intersection of the rotational axis of one of the rollers shown in FIG. 2 with the axis of the tube liner.

FIG. 2 shows that the axes 46 and 48 of the rollers 42 and the tube liner 48 respectively are off-set with respect to one another by an angle 54.

The rollers 42 include a plurality of forming discs which will be described with reference to FIG. 4. The discs on the rollers are arranged to track each other, and due to the off-set angle 54 shown in FIG. 2, a helical fin is rolled into the fin stock 52 during rotation of the arbors 44. The angle 54 determines the pitch of the helical fin, and in a particular arrangement the angle 54 may be 30 minutes (half a degree) which may result in a fin pitch of eleven per 25 mm (one inch), i.e. 2.3 mm.

Figure 3:
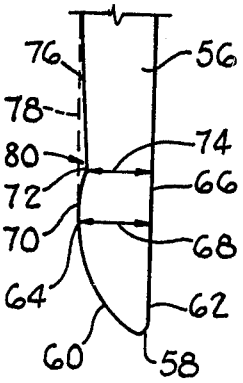
FIG. 3 shows the cross-sectional profile of the peripheral region of one configuration of a forming disc in accordance with the invention included in the rollers shown in FIG. 1.

Referring to FIG. 3, there is shown on an enlarged scale the cross-sectional profile of the peripheral region of a forming disc 56 included in the rollers 42 shown in FIG. 1. The disc 56 has a tapering but slightly rounded periphery 58 from where the profile diverges radially inwardly along curved regions 60 and 62 up to the position 64. From the curved region 62 the profile is linear as at 66. At the position 64 the axial thickness of the disc is 68. From this position the profile converges radially inwardly as at 70 up to the position 72 where the axial thickness of the disc is 74 which is smaller than the thickness 68. From 72 the profile again diverges radially inwardly linearly as at 76. The arrangement is such that a tangent 78 at the position 64 of the curved profile extending substantially parallel to the linear profile 66 extends over the recess 80 formed by the converging profile region 70 and the diverging profile region 76.

Figure 4:
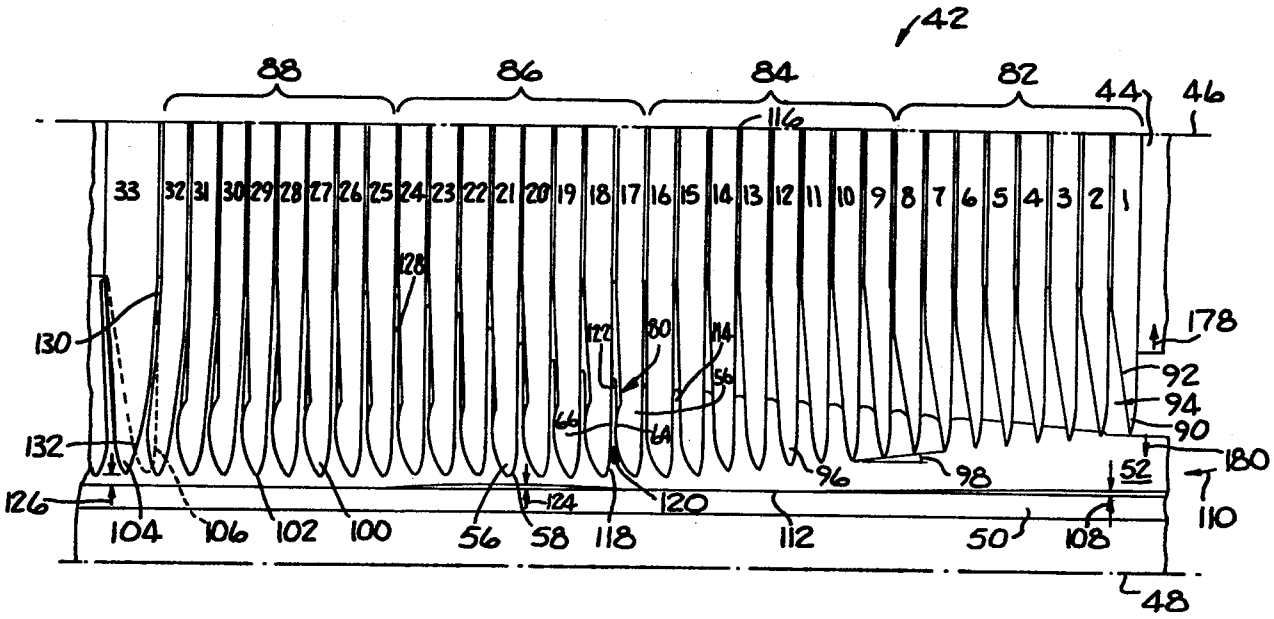
FIG. 4 shows a fragmentary side view of one arrangement of forming discs included in the rollers shown in FIG. 1.

Referring to FIG. 4, there is shown a fragmentary side view of one of the rollers 42 shown in FIG. 1 mounted on an arbor 44. The roller includes 33 forming discs numbered as indicated from 1 to 33. The discs are provided in four groups which are indicated by brackets by numerals 82, 84, 86 and 88. These groups will be described below.

The first group which is indicated by numeral 82 comprises eight discs numbered 1 to 8. These discs have cross-sectional profiles which are substantially the same and which include a sharp, wedge-shaped peripheral region 90. The profile diverges from the peripheral region 90 radially inwardly, the side 92 being inclined with respect to the axis 46. Axial spaces 94 which converge radially inwardly are defined between adjacent discs. The peripheries 90 of the discs in this group are sharp so as to present a low resistance to penetration into the tubular fin stock 52. These discs are scoring and entry discs.

The second group of forming discs indicated by numeral 82 are numbered 9 to 16. These discs have peripheral regions 96 which are also sharp and wedge-shaped similar to the peripheries 90 in the first group, except that the profiles are slightly more rounded. The discs in this group penetrate deeper into the fin stock 52 after the initial scoring made by the peripheries 90 in the first group.

The diameters of the discs 1 to 16 in the groups 82 and 84 gradually increase in diameter. The angle 98 included between the peripheries of the diametrically increasing discs and the axis 46 is approximately 6°. With the angle 98 being 6° or less, the fin stock 52 can be fed into the rollers 42 without assistance. It is also an angle which permits an economical number of discs to penetrate the fin stock 52 to a depth where the disc profile will have developed fully as in disc 16.

The third group of rollers which is indicated by numeral 86 is numbered from 17 to 24. These discs have peripheral regions having a profile 56 which has been described in more detail with reference to FIG. 3.

The fourth group of discs indicated by numeral 88 are numbered 25 to 32. They have cross-sectional profiles 100 similar to the cross-sectional profiles 56 of group 86 except that their peripheries 102 are sharper than the peripheries 58 in the profiles 56.

Finally, there is provided a buttress disc 33 which has a peripheral profile 104 similar to the peripheral profile 100 in the discs in the group 88, but the disc 33 has a greater axial width. It is furthermore resiliently flexible and in an unstressed condition is in the position indicated by dotted lines by 106.

The operation of the apparatus 40 during the rolling of a fin is described with reference to FIG. 4, and is as follows:

The tubular fin stock 52 is placed over the tube liner 50, and their respective dimensions are such that there is a small clearance 108 between the fin stock and the tube liner so that the fin stock can be slid loosely over the tube liner. The fin stock on the tube liner is fed into the three rollers 42 (shown in FIG. 1) in the direction of arrow 110. The discs 128 in group 82 first engage the fin stock 52, and due to the rotation of the arbors 44 the fin stock is contra-rotated due to rolling contact between the discs and the fin stock. The peripheries 90 of the discs 1 to 8 gradually penetrate deeper into the fin stock 52 and thereby make a helical score in the fin stock.

The second group of discs 83 numbered 9 to 16 further continue the penetration of the fin stock by their peripheries 96. At this region, due to the radial pressure exerted by the discs in the three rollers 42 against the fin stock 52, the fin stock is forced tightly against the tube liner 50 as at 112 so that the clearance 108 is eliminated. The discs 9 to 16 gradually build up a partly formed fin which has a shape 114 after the disc 16. The discs from 1 to 33 are axially spaced from each other by means of shim steel spacers 116 of various thicknesses which determine the spacing between the discs and thus the amount of material from the fin stock that is to penetrate into the spaces between the discs.

In the third group 86 of discs numbered 17 to 24 the actual shaping of the fin takes place. This is effected by compression of the fin stock in the region 118 between adjacent discs, and forcing the material through the restriction 120 formed between the curved region 64 and the linearly profiled face 66 of the adjacent roller. The material thus forced through the restriction 120 emerges as a fin 122. The fin 122 is in contact with the face 66, but due to the recessed portion 80 in the profile 56, the fin 122 is not in contact with the adjacent disc in the region of the recessed portion 80. The effect of this is that there is less frictional pull on the fin, and consequently the fin 122 is formed by a spinning motion in an outward, continuously radial, curved motion. Due to the reduced friction less power is required to rotate the rollers 42, and furthermore, less subsequent work hardening of the fin takes place.

From about discs 18 to 24 there is a tendency for the fin stock 52 to be pulled away from the tube liner as at 124, but as will be described further on, the fin stock is again subsequently forced back against the tube liner 50.

In order to ensure that the root thickness 126 of the fin stock is maintained, the diameters of the discs 17 to 24 are slightly reduced by eliminating sharp points and by having slightly rounded peripheries 58. From disc 25 to disc 33, sharp peripheries 102 are again provided on the disc.

In the fourth group 88 the discs numbered 25 to 32 gradually decrease in thickness. This results in restraining the axial movement of the fin stock 52 on the tube liner 50 and shapes the fin 128 so as to have the correct pitch distance. These discs are resiliently flexible and are gradually inclined away from the vertical, whereby lateral pressure is applied to the fin.

The final disc 33 is a buttress disc, and as mentioned above, it is resiliently flexible. The thickness of this disc determines the amount of flexing, and this is important. From its unstressed position 106 the disc 33 is flexed to the position shown in solid lines in which the disc is stressed. Thereby the disc 33 applies lateral pressure in an axial direction to the fully developed fin 130 so that in its final form the fin 130 is inclined to the axis 46.

A further function of the buttress disc 33 is that in its stressed condition as indicated in full lines, it exerts, as already pointed out above, lateral pressure against the fin 130. This pressure is exerted inter alia along the region 132 of the fin 130. This causes the fin to be forced against the tube liner 50, and thereby the gap 124 which was formed by the group 86 discs, is again eliminated. This consequently ensures good contact between the developed fin 130 and the tube liner 50, which is essential for good heat exchanging characteristics of the finned tube.

The rollers 42 are rotated at 730 rpm during the fin forming operation. At this rotational speed frictional heat is generated, and to alleviate the position a lubricant/coolant is used which includes a fatty acid.

In a particular example the tube liner 50 is of steel, more particularly carbon steel, while the fin stock 52 is aluminium. A bimetal finned tube manufactured by the method of the invention from these materials may have the following dimensions:

Finished fin diameter = 57 to 58 mm
Radial fin height = 16 mm
Fin root thickness (126) = 0.8 mm
Tube liner (50) diameter = 25.4 mm
Fin stock (52) diameter = 34.8 mm
Fin pitch = 11 fins per 25.4 mm i.e., 2.3 mm.

This is a finned tube in which the fin height is high in relation to the diameter of the tube liner (50).

Figure 5:
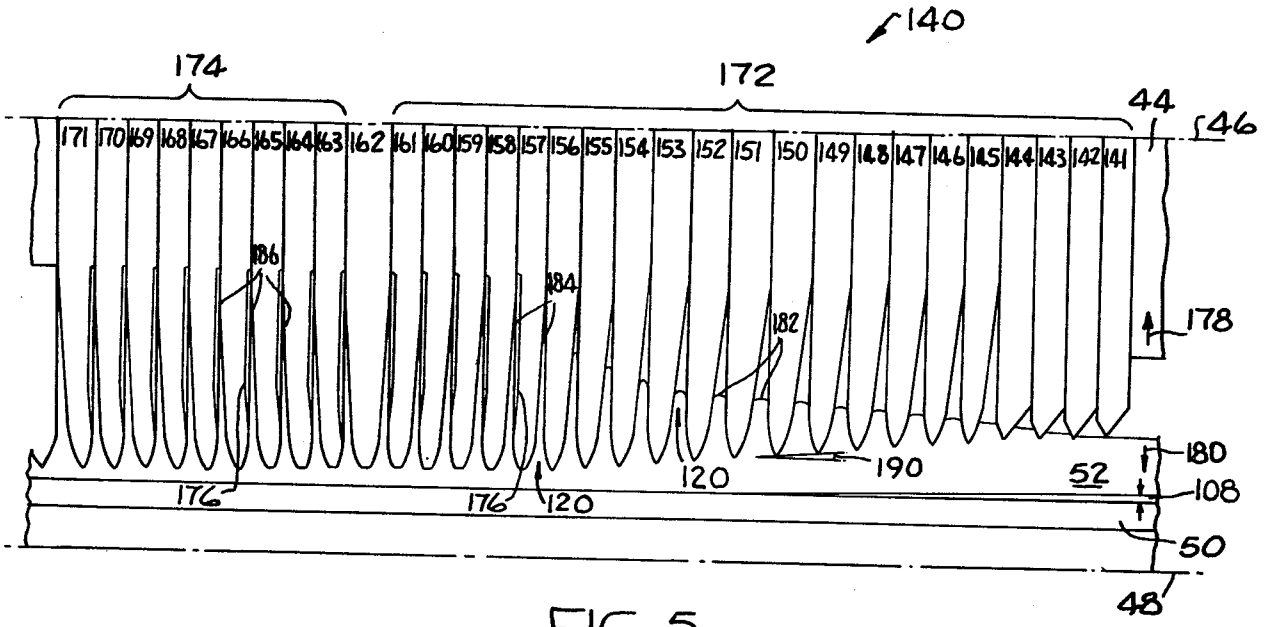
FIG. 5 shows a fragmentary side view, similar to FIG. 4, of an alternative arrangement of forming discs included in the rollers of FIG. 1.

Referring now to FIG. 5, there is shown in general by reference numeral 140 a roller similar to the roller 42 shown in FIG. 4. Similar parts such as the arbor 44 having a rotational axis 46, the fin stock 52, and the tube liner 50 having a rotational axis 48, are indicated by the same numbers. The roller 140 includes 31 discs numbered 141 to 171.

The discs 141 to 171 are mounted in two axially aligned groups 172 and 174 on the arbor 44. The first group 172 includes the discs 141 to 161 and the second group 174, the discs 163 to 171. These discs are all flexible. Between these two groups of discs there is mounted a disc 162 which is relatively stiff and inflexible compared with the flexibility of the other discs. The disc 162 is adapted to resist the flexing of the other discs when the roller 140 is in operation. The discs 141 to 171 are mounted axially adjacent each other so as to abut each other and without any spaces being provided between the discs. By not providing spacers such as the spacers 116 in the roller 42, shown in FIG. 4, the discs can be thicker and therefore stronger than the discs in the roller 42.

All the discs 157 to 171 except 162 have dished asymmetrical cross-sectional profiles. The discs 157 to 161 and 163 to 170 are basically the same except that they have different diameters and different peripheries, some of the peripheries being sharp edges and some being blunt in the form of flat peripheral surfaces. Those discs having sharp peripheries have each a diameter of 85 mm while those with blunt peripheral surfaces have each a slightly smaller diameter of about 82 mm.

Each of the discs 157 to 170, excluding 162, has a dished cross-sectional profile which includes a recess 176 radially inwardly of its periphery. This recess 176 is similar to the recess 80 in the discs shown in the roller 42 in FIG. 4. The disc 171 is similar to the disc 170 except that it is slightly thicker and does not have a recess 176 in its profile. The profiles of the various types of discs included in the discs 141 to 171 in the roller 140 are shown in greater detail in FIGS. 6 to 12.

Figure 7:
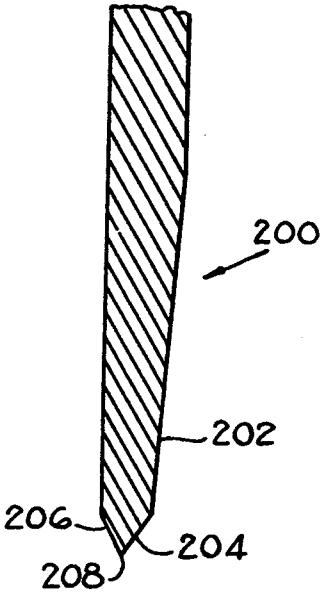

Referring further to FIG. 5, the roller 140 operates as follows in use:

The arbor 44 is rotated in the direction of arrow 178, whereby, due to frictional contact between the aluminium fin stock 52 and the discs 141 to 171, the fin stock on the liner 50 is rotated in the opposite direction 180. The discs 141 to 144 are relatively stiff and have sharp peripheral edges which score and enter into the fin stock 52. The discs 146 to 156 also have sharp peripheral edges and they penetrate deeper into the score or entry line made by the entry discs 141 to 144. The discs 145 to 156 are flexible and they may have curved cross-sectional profiles as shown in FIG. 5, or they may have angular cross-sectional profiles as shown in FIG. 7. During this stage, i.e., the penetration of the discs 145 to 156 into the fin stock 52, the fin is gradually forced into the axial spaces 120 between adjacent discs, as indicated by the fin profiles 182.

The next series of discs in the group 172 are the discs 157 to 161. These discs have dished cross-sectional profiles each having a recess 176, and each having a blunt flat peripheral surface. These discs semi-form and shape the fin 184 substantially in the same manner as group 88 as described with reference to FIG. 4. The effect of the recessed portions 176 is the same as that of the recessed portion 80 as described with reference to FIG. 4, namely that over the recessed portion of the profile the fin is not in contact with the disc and therefore there is less frictional pull on the fin and thus less tendency of the fin stock 52 to be pulled away from the tube liner 50. The discs 157 to 161 are flexible and are dished towards the restraining disc 162. The effect of their dished cross-sectional profiles is to resist lateral axial pressure exerted by the fin against the discs and thus to resist deformation of the discs. The dished configuration of the discs further tends to resist the tendency of the fin stock 52 to be pulled away from the tube liner 50.

The restraining disc 162 is relatively stiff and inflexible and resists deformation of the discs in the group 172 due to axial lateral pressure exerted by the incipient fins 182 and 184. It also assists in resisting deformation of the discs in group 174.

The group of discs 174 effect a finishing operation on the fin 186, more or less in the manner of the group of discs 88, in FIG. 4. These discs are also dished and flexible and their dished shapes resist axial deformation. The discs 163 to 168 have blunt peripheral surfaces while the discs 169 to 171 have sharp peripheral surfaces. The further function of the discs 163 to 171 is to counteract any tendency of the fin stock 52 to be pulled away from the tube liner 50.

The discs 157 to 168, as mentioned above, have blunt peripheral surfaces and are marginally smaller in diameter than the discs 169 to 171. The effect of the blunt peripheral surfaces is to provide the desired root thickness in the fins 184, 186 and to resist any tendency of the fin stock 52 to be pulled away from the tube liner 50 and thus to force the fin stock 52 onto the tube liner 50. As a result, the applicant has found that the fin stock 52 is forced back onto the tube liner 50 from about disc 152 to thereby eliminate the initial clearance 108.

The arrangement mentioned above, namely that the overall diameter of each of the discs 170 and 171 is marginally larger than the overall diameter of the blunt surfaced discs 157 to 169, further assists in forcing the fin stock 52 back onto the tube liner 50.

Yet a further factor which assists in ensuring that the fin stock 52 is forced onto the tube liner 50 is the fact that the discs 141 to 156 and then again the discs 169 to 171 have sharp peripheral edges. The effect of this is that the fin root is sharp-edged i.e. the space between fins is sharp-edged. By being thus sharp-edged, as small a surface area as possible is in contact with the discs, thus frictional resistance can be kept low, and thereby the tendency for the discs to pull the fin stock away from the tube liner 50 is resisted.

The angle of inclination 190 of the peripheral surface of the discs 141 to 156 is similar to the angle of inclination 98 shown in FIG. 4, i.e. in the region of 6°. A similar angle of inclination of the peripheral surfaces of the discs 141 to 156, which is not indicated, is about 1°.

The discs 141 to 171 are of shock-resistant steel and are hardened to 47 Rockwell C-hardness with a tolerance of ± 1. The aluminium of the fin stock 52 is soft grade and is of the type known as 50S or HT9.

Figure 6:
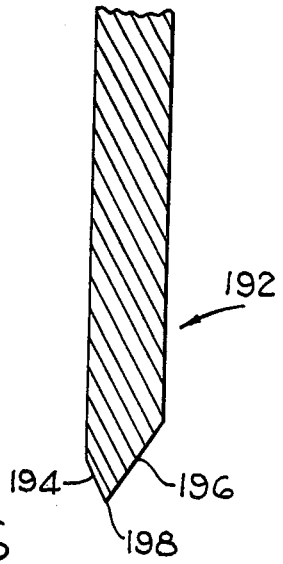
FIGS. 6 to 12 are fragmentary views on an enlarged scale of some of the discs included in the arrangement shown in FIG. 5.

Referring now to FIGS. 6 to 12, the cross-sectional profiles of the discs 141 to 171 in the roller 140 shown in FIG. 5, are shown in greater detail. FIG. 6 shows the cross-sectional profile 192 of the discs 141 to 144. The profile includes two flat faces 194 and 196 intersecting at a sharp edge 198.

FIG. 7 shows the cross-sectional profile 200 of the discs 145 to 156. The profile is angular and includes three flat surfaces 202, 204 and 206, the latter two surfaces intersecting at a sharp peripheral edge 208. The profiles of the discs 145 to 156 are shown to include curved sections. These profiles are alternative to the angular profile 200 which may be provided on these discs.

Figure 8:
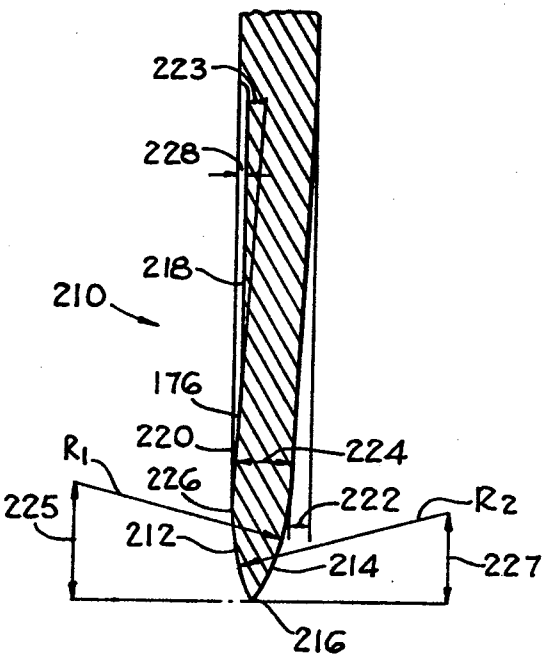

FIG. 8 shows the cross-sectional profile 210 of the discs 169 and 170. It has an overall diameter of 85 mm and has two curved surfaces 212 and 214 intersecting at a sharp peripheral edge 216. The profile further includes a linear face 218 which merges with a linear face 220 which is a tangent to the curve 212. The faces 218 and 220 merge at 176 so that the region 176 is recessed with respect to the adjacent surfaces 218 and 220. The profile has a thickness 224 of 1.6 mm. The profile 210 is dished and asymmetrical, and the face 218 is recessed inwardly from the rounded region 226 by an amount 228 which is about 0.25 mm. The angles 222 and 223 are respectively 3° and 4°, the radii $R_1$ and $R_2$ are each 6.25 mm and the dimensions 225 and 227 are respectively 3.56 mm and 2.55mm.

Figure 9:
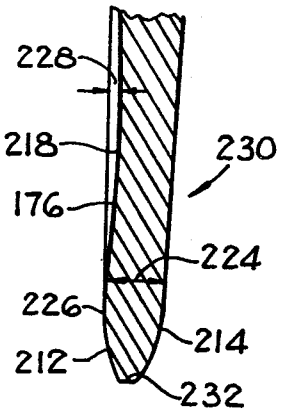

FIG. 9 shows a cross-sectional profile 230 provided on the disc 157 to 161. The profile 230 is identical to the profile 210 shown in FIG. 8, except that the surfaces 212 and 214 do not intersect at a sharp edge but are interconnected by means of a flat peripheral surface 232. The profile 230 has an overall diameter of about 82 mm.

Figure 10:
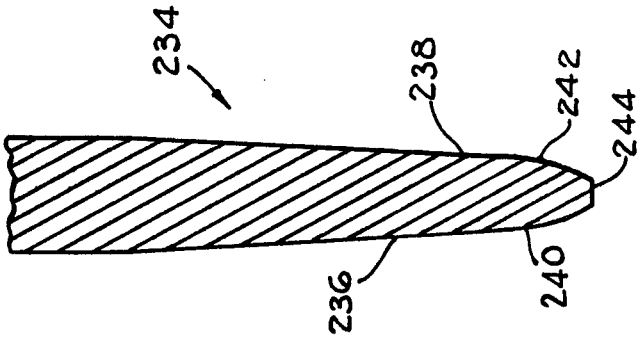

FIG. 10 shows the cross-sectional profile 234 of the restraining disc 162. It has two tapering flat surfaces 236 and 238 blending into two curved surfaces 240 and 242 which are interconnected by a flat peripheral surface 244. The overall diameter of the profile 234 is 82 mm.

Figure 11:
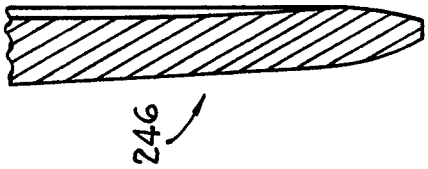

FIG. 11 shows a cross-sectional profile 246 for the discs 163 to 168. The profile 246 is identical to the profile 230 shown in FIG. 9.

Figure 12:
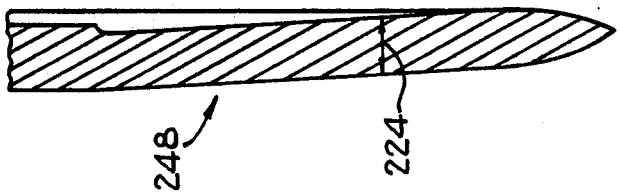

FIG. 12 shows a cross-sectional profile 248 for the disc 171. The profile 248 is similar to the profile 210 in FIG. 8 except that the profile has a uniform thickness 224 equal to 1.6 mm i.e. the recessed region 220 which is included in the profile 210 is eliminated. The profile 248 is also dished and the overall diameter is also 85 mm.

Referring again to FIGS. 4 and 5, the pitch of the peripheral surfaces of the discs 1 to 33 and 141 to 171 is not constant. In roller 42 the pitch of the gap between discs 1 and 2 is 2.3 mm and it progressively increases until a value of 3.3 mm is reached in the gap between about discs 10 and 11. Thereafter it again decreases until 2.3 mm is reached in the gap between discs 32 and 33. The variation in the pitch is effected by a variation in the thickness of the spacers 116. In roller 140 the pitch likewise progressively increases from 2.3 mm between discs 141 and 142 to 3.3 mm between discs 150 and 151. Thereafter the pitch again decreases until 2.3 mm is reached in the gap between discs 161 and 162. Thereafter the pitch remains at 2.3 mm. The variation in pitch is effected by a variation in the thickness and construction of the discs.

The purpose of varying the pitch is to permit the fin stock material to be gathered and squeezed between the discs so that thereby the fin stock can be forced into the gaps between the discs to initiate fin formation.

It is an advantage of a method and apparatus for manufacturing finned tubing in accordance with the invention in which the profiles of the forming discs are recessed that by arranging the fin during at least a part of the extrusion process not to contact one of the forming discs over the distance that the profile is recessed, there is less friction between the fin and the forming discs. This has a two fold advantageous effect. Firstly, less power is required to rotate the rollers and as a result less subsequent work hardening takes place.

Secondly, there is less radial pull by the forming discs on the fins than when the profiles of the discs are not recessed with the result that there is less tendency for the fin stock to be pulled away from the tube liner. In addition, the flexing of the buttress disc in particular forces the fin against the liner. The overall effect is therefore that a good bond between the fin and the liner is ensured which is essential for efficient heat exchanging.

I claim:

1. A method of manufacturing finned tubing from tubular metal fin stock on a tube liner by means of a plurality of rollers rotatably drivable by means of arbors and each roller including a plurality of axially arranged forming discs, the method including deforming the metal of the fin stock to form a fin by forcing the metal into a restricted radially directed axial space defined between adjacent forming discs so that metal is uninterruptedly in contact with a portion of the axially directed face of one disc defining the restricted space but is only in partial contact with the opposing axially directed face of the adjacent disc defining the restricted space, there being no contact over a radially extending portion spaced radially inwardly from the disc periphery.

2. A method as claimed in claim 1, in which at least some of the discs are resiliently flexible and the method includes applying lateral pressure in an axial direction to the fin by deflection of a forming disc.

3. A method as claimed in claim 2, in which the fin is inclined with respect to the axis of the tube liner during the application of lateral pressure to the fin.

4. A method as claimed in claim 1, in which the forming disc with which the fin is only in partial contact has a cross-sectional profile including a recess in at least one axial side of the disc.

5. A method as claimed in claim 4, in which the cross-sectional profile including the recess includes a smoothly curved region inwardly of the periphery of the disc and being so shaped that the profile initially diverges from the periphery of the disc in a radially inward direction and then converges and thereafter again diverges radially inwardly.

6. A method as claimed in claim 2, in which at least some of the discs are dish-shaped when not in use and are mounted so that their dished faces are directed against the direction in which lateral pressure is applied to the fin, the lateral pressure tending to deform the discs, and the dished shapes of the fins tending to resist such lateral pressure and deformation under the lateral pressure.

7. A method as claimed in claim 1, in which the discs are provided in at least two groups, the discs in one group effecting penetration of the fin stock and initial forming of the fin and another group effecting final forming and finishing of the fin.

8. A method as claimed in claim 7, in which the second group of discs effect radially extending the fin and forcing the fin back onto the tube liner.

9. A method as claimed in claim 7, in which the discs are provided in two groups by positioning a stiff, relatively inflexible restraining disc between the two groups, the restraining disc resisting deformation of the two groups of discs under lateral pressure applied to the discs.

10. A method as claimed in claim 9, in which dished discs in the two groups are so mounted that their dished faces are directed towards the restraining disc to thereby control the pitch of the fins on the tube liner.

11. A method as claimed in claim 9, in which at least four of the discs immediately adjacent either axial side of the restraining disc have blunt peripheries in the form of flat peripheral surfaces.

12. A method as claimed in claim 1, in which each roller includes 31 discs.

13. A method as claimed in claim 1, in which some of the discs have sharp peripheral edges.

14. A method as claimed in claim 7, which includes providing the discs in four groups, the first group having sharp wedge-shaped peripheries facilitating penetration of the tubular fin stock, the second group having cross-sectional profiles similar to those in the first group but less sharp and slightly curved and of gradually increasing thickness to compress metal between the disc, the third group having slightly curved cross-sectional profiles with recessed regions for forming and raising the fin, and the fourth group having cross-sectional profiles similar to but slightly sharper than those of the third group to perform a finishing action on the fin.

15. A method as claimed in claim 1, in which the diameters of the discs at one axial end of the roller increase in the axial direction of the roller.

16. A method as claimed in claim 15, in which the angle of a line extending axially over the peripheries of the diametrically increasing discs with respect to the axis of the tube liner is about 6°.

17. A method as claimed in claim 1, in which the axis of the arbor is inclined to the axis of the tube liner at an angle of 30 minutes.

18. A method as claimed in claim 1, in which the pitch of the fin is eleven fins per 25 mm.

19. A method as claimed in claim 1, in which the arbors rotate at 730 rpm.

20. A method as claimed in claim 1, which includes using a lubricant/coolant including a fatty acid.

21. A method as claimed in claim 1, which includes providing the discs so that the pitch of the axial gaps between the peripheries of at least some of the discs varies.

22. A method as claimed in claim 21, in which the pitch of the gaps increases in an axially inward direction of the arrangement of discs and then again decreases, the pitch at each axial end of the arrangement of discs being the same.

23. An apparatus for manufacturing finned tubing from tubular metal fin stock on a tube liner, the apparatus including a forming disc which is mountable on a rotatably drivable arbor so as to be rotatable in a direction transverse to the rotational axis of the arbor, the disc having a cross-sectional profile of which a radially extending portion is recessed in the axial direction of the disc with respect to the profile regions which are radially adjacent to the recessed region.

24. An apparatus according to claim 23, in which the disc is resiliently flexible in its axial direction and is capable of applying lateral pressure in the axial direction of the disc to a fin formed from fin stock.

25. An apparatus according to claim 23, in which the disc has an asymmetrical cross-sectional profile.

26. An apparatus according to claim 23, in which the disc is dish-shaped.

27. An apparatus according to claim 26, in which the recessed portion of the disc is provided in the dished surface.

28. An apparatus according to claim 23, in which the cross-sectional profile of the disc includes curved portions which are so shaped that the profile initially diverges from the periphery of the disc in a radially inward direction and then converges and thereafter again diverges radially inwardly.

29. An apparatus according to claim 23, in which the cross-sectional profile of the disc in the face in which the recessed portion is provided includes an annular shoulder at the radially inward extremity of the profile.

30. An apparatus according to claim 23, in which the periphery of the disc is a sharp edge.

31. An apparatus according to claim 23, in which the periphery of the disc is blunt and is in the form of a peripherally extending flat surface.

32. An apparatus according to claim 23, in which the thickness of the disc is 1.6 mm.

33. An apparatus according to claim 23, in which the recessed portion of the cross-sectional profile of the disc is provided in one axial side only of the disc.

34. A roller for manufacturing finned tubing from tubular metal fin stock on a tube liner, the roller including a plurality of discs mounted in an axial arrangement on an arbor in which at least some of the discs are as claimed in claim 23.

35. A roller according to claim 34, in which the discs are mounted so that they abut each other axially.

36. A roller according to claim 34, in which spacers are provided between the discs so that the discs are thereby axially separated from each other.

37. A roller according to claim 34, in which the discs are provided in at least two groups, the discs in one group effecting penetration of the fin stock and initial forming of the fin and another group effecting final forming and finishing of the fin.

38. A roller according to claim 37, in which a stiff, relatively inflexible restraining disc is positioned between the two groups, the restraining disc resisting deformation of the two groups of discs under lateral pressure applied to the discs.

39. A roller according to claim 38, in which both groups include dished discs and are so mounted that their dished faces are directed towards the restraining disc.

40. A roller according to claim 37, in which at least four of the discs immediately adjacent either axial side of the restraining disc have blunt peripheries in the form of flat peripheral surfaces.

41. A roller according to claim 34, which includes 31 discs.

42. A roller according to claim 34, which includes 33 discs.

43. A roller according to claim 34, which includes four groups of discs, the first group having sharp wedge-shaped peripheries facilitating penetration of the tubular fin stock, the second group having cross-sectional profiles similar to those in the first group but less sharp and slightly curved and of gradually increasing thickness to compress metal between the discs, the third group having slightly curved cross-sectional profiles with recessed regions for forming and raising the fin, and the fourth group having cross-sectional profiles similar to but slightly sharper than those of the third group to perform a finishing action on the fin.

44. A roller according to claim 34, in which the diameters of the discs at one axial end of the roller increase in the axial direction of the roller.

45. A roller according to claim 44, in which the angle of a line extending axially over the peripheries of the diametrically increasing discs with respect to the axis of the tube liner is about 6°.

46. A roller according to claim 34, in which the pitch of the axial gaps between the peripheries of at least some of the discs varies.

47. A roller according to claim 46, in which the pitch of the gaps increases from one axial end of the roller axially inwardly and then again decreases towards the other axial end, the pitch at each axial end of the roller being the same.

* * * * *